United States Patent [19]

De Roo et al.

[11] 4,039,463

[45] Aug. 2, 1977

[54] ELECTROSTATOGRAPHIC DEVELOPERS COMPRISING A CARRIER BEAD COATED WITH A COPOLYMER OF N-VINYLCARBAZOLE AND TRIALKOXYVINYLSILANE AND/OR TRIACETOXYVINYLSILANE

[75] Inventors: Pierre Richard De Roo, Schoten; Walter Frans De Winter, 's-Gravenwezel; Jan Jozef Priem, Mortsel; Yvan Karel Gilliams, Berchem, all of Belgium

[73] Assignee: AGFA-GEVAERT N.V., Mortsel, Belgium

[21] Appl. No.: 568,400

[22] Filed: Apr. 16, 1975

[30] Foreign Application Priority Data

Apr. 30, 1974 United Kingdom ..... 18884/74

[51] Int. Cl.[2] ..... G03G 9/10

[52] U.S. Cl. ..... 252/62.1 P; 96/1 SD; 96/1.2; 252/62.1 R; 427/19; 427/20; 428/402; 428/403; 428/404; 428/405; 428/406; 428/407; 526/263; 526/279

[58] Field of Search ..... 428/407, 403, 405, 406, 428/402; 252/62.1 P, 62.1 R; 427/19, 20; 96/1 SD, 1.2; 526/263, 279

[56] References Cited

U.S. PATENT DOCUMENTS

| | | | |
|---|---|---|---|
| 3,627,522 | 12/1971 | Jacknow et al. | 252/62.1 |
| 3,811,880 | 5/1974 | Browning | 252/62.1 |
| 3,840,464 | 10/1974 | Van Engeland et al. | 252/62.1 |
| 3,916,065 | 10/1975 | Moriconi et al. | 252/62.1 |

*Primary Examiner*—Mayer Weinblatt
*Assistant Examiner*—John D. Smith
*Attorney, Agent, or Firm*—William J. Daniel

[57] ABSTRACT

Carrier beads for use in an electrostatographic developer mixture comprise a glass core or iron-containing metal core enveloped with a coating of a copolymer of N-vinylcarbazole, trialkoxyvinylsilane and/or triacetoxyvinylsilane and optionally one or both of the monomers of the group consisting of $C_1$–$C_4$ alkyl (meth)acrylate and styrene.

8 Claims, No Drawings

ELECTROSTATOGRAPHIC DEVELOPERS COMPRISING A CARRIER BEAD COATED WITH A COPOLYMER OF N-VINYLCARBAZOLE AND TRIALKOXYVINYLSILANE AND/OR TRIACETOXYVINYLSILANE

The present invention relates to particle material known as "carrier material" used in the development of electrostatic charge images, to an electrostatographic developer mixture containing said carrier material and to the use of such mixture.

It is known to develop an electrostatic charge pattern on a charge-carrying member with a finely divided electroscopic material referred to in the art as "toner". The toner will normally be attracted to the charged areas of the charge carrying member thereby forming a toner image corresponding to the charge pattern. The toner image may be fixed on said member or transferred, usually electrostatically, to another support e.g. paper and then fixed thereon.

Many methods are known for applying the electroscopic particles to the charge pattern to be developed. A now commonly used method known as "cascade" development is described by E. N. Wise in the U.S. Pat. No. 2,618,552 of Edward N. Wise issued Nov. 18, 1952. In this method developer material comprising relatively large carrier particles having finely divided toner particles electrostatically clinging to the surface of the carrier particles is conveyed to and rolled or cascaded across the electrostatic latent image-bearing surface. The composition of the toner particles is so chosen as to have a triboelectric polarity opposite to that of the carrier particles. In order to develop a negatively charged electrostatic latent image, an electroscopic powder and carrier combination should be selected in which the powder is triboelectrically positive in relation to the carrier. Conversely, to develop a positively charged electrostatic latent image, an electroscopic powder and carrier combination should be selected in which the powder is triboelectrically negative in relation to the carrier. This triboelectric relationship between the powder and carrier depends on their relative positions in a triboelectric series, in which the materials are arranged so that each material is charged with a positive electrical charge when contacted with any material below it in the series and with a negative electrical charge when contacted with any material above it in the series. As the mixture cascades or rolls across the image-bearing surface, the toner particles are electrostatically deposited on and secured to the charged portions of the latent image and are not secured to the uncharged or background portions of the image. The "cascade" development process has the distinct advantage that most of the toner particles accidentally deposited on the background portion are removed by the rolling carrier, due apparently to the greater electrostatic attraction between the toner and the carrier than between the toner and the discharged background. The carrier particles and unused toner particles are then recycled. The cascade development process is extremely good for the development of line copy images.

A general purpose office copying machine incorporating this technique is described in U.S. Pat. No. 3,099,943 of Roger H. Eichorn, Richard W. Morrill, Karl N. Northrup and Robert F. Osborne issued Aug. 6, 1963.

Another technique for developing electrostatic images is the "magnetic brush" process as disclosed, for example, in U.S. Pat. No. 2,874,063 of Harold G. Greig issued Feb. 17, 1959. In this process, a developer material containing toner and magnetic carrier particles is attracted to and is carried by a magnet. The magnetic field of the magnet causes an alignment of the magnetic carriers in a brush-like configuration. This "magnetic brush" is engaged with an electrostatic bearing surface and the toner particles are drawn from the brush to the electrostatic image by electrostatic attraction.

In automatic electrostatographic reproducing equipment, it is conventional to employ an electrostatographic imaging surface in the form of a cylindrical drum, which is continuously rotated through a cycle of sequential operations including charging, exposure, developing, transfer and cleaning. The imaging surface is usually charged with a corona with positive polarity by means of a corona-generating device of the type disclosed e.g. by L. E. Walkup in U.S. Pat. No. 2,777,957 issued Jan. 15, 1957, which is connected to a suitable source of high potential. After forming a powder image on the electrostatic image during the development step, the powder image is electrostatically transferred to a support surface by means of a corona-generating device such s the corona device mentioned above. In automatic equipment employing a rotating drum, a support surface to which a powdered image is to be transferred from the drum is moved through the equipment at the same rate as the periphery of the drum and contacts the drum in the transfer position interposed between the drum surface and the corona-generating device. Transfer is effected by the corona-generating device which imparts an electrostatic charge to attract the powder image from the drum to the support surface. The polarity of charge required to effect image transfer is dependent upon the visual form of the original copy relative to the reproduction and the electroscopic characteristics of the developing material employed to effect the development. For example, where a positive reproduction is to be made of a positive original, it is conventional to employ a positive polarity corona to effect transfer of a negatively charged toner image to the support surface.

A residual powder image and occasionally carrier particles remain on the plate after transfer. Before the plate may be reused for a subsequent cycle, it is necessary that the residual image and carrier particles, if any, be removed.

Carrier particles must be made from or coated with materials having appropriate triboelectric properties as well as certain other physical characteristics. Thus, the materials employed in the carrier particles should have a triboelectric value commensurate with the triboelectric values of the toner and the imaging surface to afford electrostatic transfer of the toner to the carrier particle and subsequent transfer of the toner from the carrier particle to the image of the imaging surface without excessive power requirements. Furthermore, the triboelectric properties of all the carrier particles should be relatively uniform to permit uniform pick-up and subsequent deposition of toner. The materials employed in the carrier particles also should have an intermediate hardness so as not to scratch the imaging surface upon which the electrostatic image is initially placed while being sufficiently hard to withstand the forces to which they are subjected during recycle. The carrier particles as well as the surface thereof also should not be comprised of materials which are so brittle as to cause either flaking of the surface or particle break-up under the forces exerted on the particles during recycle. The flaking causes undesirable effects in that the relatively small flaked particles will eventually be transferred to the copy surface thereby interfering with the deposited toner and causing imperfections in the copy image. Furthermore, flaking of the carrier particle surface will cause the resulting carrier particles to have non-uniform triboelectric properties when the carrier particle is composed of a core material different from the surface coating thereon. This results in undesirable non-uniform pick-up of toner by the carrier particles and non-uniform deposition of toner on the image. Thus, the types of materials useful for making carrier particles or for coating carrier particles, although having the appropriate triboelectric properties, are limited because other physical properties which they possess may cause the undesirable results discussed above.

It is highly desirable to alter triboelectric properties of the carrier particles to accommodate them to desirable toner compositions while retaining the other desirable physical characteristics of the carrier particles. The alteration of the triboelectric properties of carrier particles by applying a surface coating thereon is a particularly useful technique.

Coating the carrier particles with a material to alter the triboelectric properties thereof rather than blending said material into the carrier material during initial formation of the carrier particles is preferred since less material need be employed to effect the desired change in the triboelectric value. Furthermore, the addition of high concentrations of additive to the original carrier material to alter the triboelectric value thereof requires a major manufacturing operation and often undesirably alters the original physical characteristics of the carrier material.

Well-known carrier particles have a core which is coated with the material providing the necessary triboelectric properties to the carrier particles.

Accordng to the U.S. Pat. No. 3,507,686 of Robert J. Hagenbach issued Apr. 21, 1970 typical carrier core materials include sodium chloride, ammonium chloride, aluminium potassium chloride, Rochelle salt, sodium nitrate, granulat zircon, granular silicon, glass, silicon dioxide, flint-shot, iron, steel, ferrite, nickel, carborundum and mixtures thereof. Many of the foregoing and other typical carriers are described by L. E. Walkup in U.S. Pat. No. 2,618,551 issued Nov. 18, 1952, in U.S. Pat. No. 2,638,416 of Lewis E. Walkup and Edward N. Wise issued May 12, 1953 and in U.S. Pat. No. 2,618,552 of Edward N. Wise issued November 18, 1952. An ultimate homogeneous or coated carrier bead diameter between about 30 $\mu$m to about 1,500 $\mu$m is preferred for electrostatographic use because the carrier bead then possesses sufficient density and inertia to avoid adherence to the latent electrostatic images during the cascade development process. Adherence of carrier beads to an electrostatographic drum is undesirable because of the formation of deep scratches on the drum surface during image transfer and drum cleaning steps, particularly where cleaning is accomplished by a web cleaner such as the web cleaner disclosed in U.S. Pat. No. 3,186,838 of William P. Graff, Jr. and Robert W. Gundlach issued June 1, 1965.

For the production of carrier particles iron or glass beads are used.

According to the published German Patent Application (Offenlegungsschrift) P 21 64 906 filed Dec. 28, 1971 by Agfa-Gevaert AG, glass beads with desired triboelectric properties are obtained by enveloping them with a layer of a polymer such as ethylcellulose, polystyrene, copolymers of styrene and n-butyl methacrylate, polyvinyl butyral, unsaturated polyesters and epoxy resins. The enveloping with the polymer is preceded by the covering of the glass beads with a covering layer on the basis of a trialkoxysilane improving the adherence of the polymer to the beads.

It would be interesting, however, when such precoating could be omitted and a direct strong adherence of the polymer providing the desired triboelectric properties to the core material could be obtained.

It is an object of the present invention to solve that problem and to provide a carrier material that can be manufactured in a less complicated and more efficient way.

It has now been found that said object can be accomplished by using as coating polymer for glass beads and iron-containing metal beads a copolymer of at least 50% by weight of N-vinylcarbazole units and from 0.5 to 10% by weight of vinyltrialkoxysilane and/or vinyltriacetoxysilane units and optionally monomer units of the group consisting of $C_1$–$C_4$ alkyl(meth)acrylate and styrene.

According to a preferred embodiment the coating polymer contains from 50 to 70% by weight of N-vinylcarbazole from 25 to 48% by weight of methyl acrylate, from 2 to 5% by weight of triacetoxyvinyl silane or trialkoxyvinylsilane e.g. trimethoxyvinylsilane or triethoxyvinylsilane.

The N-vinylcarbazole units provide to the carrier particles with respect to the common resin toners a positive charge so that the toner becomes negatively charged.

The trialkoxyvinylsilane and/or triacetoxyvinylsilane units in the copolymer provide a strong adherence of the copolymer to glass and metal beads of a hydrophilic metal such as iron and steel.

The $C_1$–$C_4$ alkyl (meth)acrylate and/or styrene yield the desired hardness, toughness and durability.

The different monomers indicated above may be copolymerized according to methods known in the art. For example, the monomers are allowed to react in an appropriate organic solvent or aqueous medium in the presence of a catalyst.

The copolymers used according to the present invention have preferably a molecular weight high enough to offer an intrinsic viscosity in dichloromethane at 25° C of at least 0.7 $dl.g^{-1}$.

In order to illustrate the preparation of said copolymers the preparation of copolymer 1 of the Table is given in detail hereinafter.

TABLE

| No. | Structural formula | | x % by weight | y % by weight | z % by weight | Intrinsic viscosity [η] at 25° C in $CH_2Cl_2$ ($dl.g^{-1}$) |
|---|---|---|---|---|---|---|
| 1 | 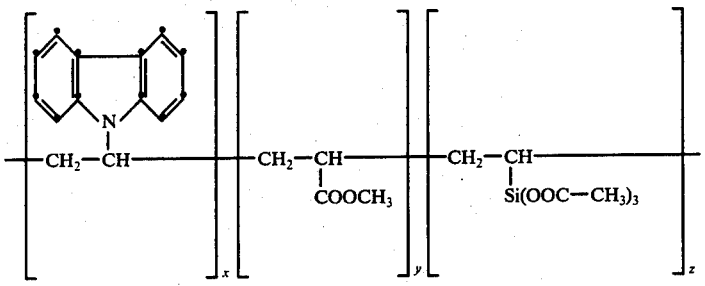 | a) | 60 | 38 | 2 | 1.08 |
| | | b) | 60 | 38 | 2 | 3.1 |
| 2 | 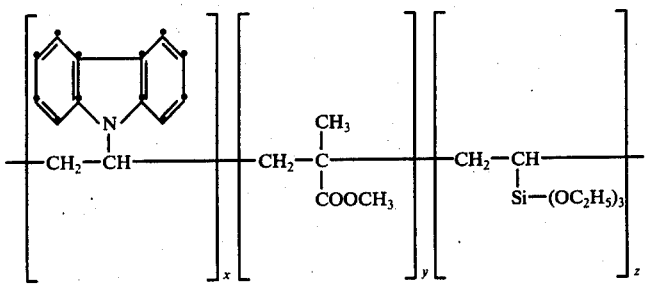 | | 60 | 35 | 5 | 2.85 |
| 3 | 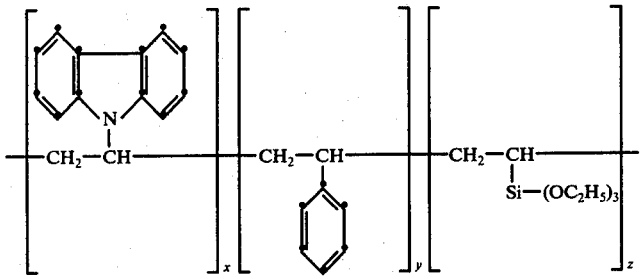 | a) | 60 | 38 | 2 | 1.33 |
| | | | | | | or |
| | | b) | 60 | 35 | 5 | 1.26 |

Preparation of Copolymer 1

In a 700 ml reaction flask 400 ml of a 1.25% by weight aqueous solution of oleylmethyl tauride were placed. To this solution 60 g of N-vinylcarbazole were added whilst stirring. Through the stirred suspension nitrogen gas was bubbled for 30 min. at 20° C. After cutting off the nitrogen gas stream the suspension was heated as quickly as possible up to 75° C and via two separate dropping funnels at one side a solution of 2 g of triacetoxyvinylsilane in 38 g of methyl acrylate and at the other side a solution of 0.5 g of 4,4'-azocyanopentanoic acid in 20 ml of water at a pH of 8.5 were added at even speed in a period of time of 15 min. After the addition of two solutions stirring and heating at 75° C was continued for still 30 min and thereupon the polymerization completed by heating at 90° C for 1 h.

The obtained copolymer in latex form was cooled and filtered (about 30 g of a coagulated mass was left on the filter).

Yield: 425 ml of latex with a solid content of 14.6%.

To 400 ml of said latex a saturated aqueous solution of sodium chloride was added up till solidification. Then 2 l of ethanol were added. The obtained precipitate was freed from the supernatant liquid. The precipitated copolymer was mixed again with water and after decantation treated again with ethanol. The obtained polymer mass was filtered and dried.

The copolymer was soluble in methylene chloride. The intrinsic viscosity measured in methylene chloride at 25° C was 1.08 $dl.g^{-1}$.

In order to apply the coatings to the uncoated carrier particles, any conventional solvent coating process can be employed. Thus, the present copolymer can be reduced to a liquid or semi-liquid state by dissolving it in a suitable solvent.

The uncoated carrier particles are intimately contacted with the dissolved copolymer in order to completely coat the particles. The conditions of contact, including temperature, coating material concentration and uncoated carrier particle concentration, are regulated preferably so that a coating as uniform as possible is applied to the uncoated carrier particles thereby forming coating particles exhibiting a uniform triboelectric value. Similarly, these conditions are maintained so that the coating thickness does not become excessive and promotes formation of carrier particle agglomerates. After contact of the uncoated particles and the coating material and/or during contact thereof, the mixture can be treated to solidify the coating material on the particles as for example, by evaporating the solvent. A particularly suitable method for evaporating the solvent is by contacting the mixture with a stream of inert gas, for example, air. The resultant carrier particles having the coating solidified thereon are then screened to separate the particles of the desired size, which are then ready for use in electrostatographic processes.

Halogenated solvents such as methylene chloride, ethylene chloride and the like can be suitably employed.

Generally, the copolymer can be dissolved in a suitable solvent to form a coating solution containing from 5 to 20 percent by weight of solids. Preferably, the solids content is about 10 percent by weight.

In coating the above mentioned core material e.g. from 0.7 to 4 g of copolymer are applied per kg of core beads.

It is most convenient to remove the solvent from the coating material-carrier particle mixture by contact with an inert gas stream from which it can be condensed and recycled for further use.

Particularly suitable carrier beads have a diameter in the range of 600 to 800 μm but may size e.g. within the range of 30 to 1500 μm.

According to the present invention an electrostatographic developer mixture is provided comprising finely-divided toner particles electrostatically clinging to the surface of carrier beads, each of said carrier beads comprising a glass or iron-containing metal (iron or steel) core being enveloped with a coating of said copolymer.

Any suitable pigmented or dyed electroscopic toner material may be employed in the developers of this invention. Typical toner materials include : gum copal, gum sandarac, rosin, coumarone-indene resin, asphaltum, gilsonite, phenol-formaldehyde resins, rosin-modified phenol-formaldehyde resins, methacrylic resins, polystyrene resins, polypropylene resins, epoxy resins, polyethylene resins and mixtures thereof. The particular toner material to be employed obviously depends upon the separation of the toner particles from the treated carrier beads in the triboelectric series.

Suitable toners are described, e.g. in the published German Patent Application P 21 65 328 filed Dec. 29, 1971 by Agfa-Gevaert AG and in the U.K. Patent Application 45376/72 filed October 2, 1972 by the Applicant. Further are to be mentioned the toner compositions of U.S. Pat. No. 2,659,670 of Harold E. Copley issued November 17, 1953; U.S. Pat. No. 2,753,308 of Richard B. Landrigan issued July 3, 1956; U.S. Pat. No. 3,079,342 of Michael A. Insalaco issued Feb. 26, 1963; U.S. Pat. No. Re. 25,136 filed June 12, 1961 of Chester F. Carlson and U.S. Pat. No. 2,788,288 of John J. Rheinfrank and William D. Jones issued Apr. 9, 1957. These toners generally have an average particle diameter between 1 and 30 μm.

Normally 1 part by weight of toner powder is mixed with about 100 parts by weight of granular carrier material but this ratio may be adapted to the desired result.

The following examples further described methods of preparing the carrier particles and carrier-toner developer compositions according to the present invention.

EXAMPLE 1

Coated glass carrier particles were made and tested as follows:

1500 g of glass beads of 600 μm were placed in a tumbling barrel type mixer. Then 52 g of a 10% by weight solution of the copolymer of N-vinylcarbazole, methyl acrylate and triacetoxyvinylsilane (60/38/2 by weight) in methylene chloride was charged to the tumbling barrel mixer. The resulting mixture was mixed for about 45 min. During mixing, no air flow was allowed for the first 20 min. Thereupon air of about 50° C was directed into the barrel for 20 min to evaporate the solvent. Thereafter, air of about 25° C was directed into the barrel to solidify the coating on the beads. The coated beads dried very well with only a small percentage of agglomerates. The beads were then screened successively through a 25 mesh screen and a 35 mesh screen to obtain glass carrier beads uniformly coated with the copolymer.

The coated beads were mixed with a toner prepared according to example 2 of the afore-mentioned published German Pat. Appln. P 21 65 328 corresponding with U.K. Patent Specification 1,359,818 filed Dec. 30, 1970 by the Applicant, and the developer composition was used for the development of positive electrostatic charge patterns obtained on a photo-conductive selenium coating.

In every respect, the electrostatographic prints showed excellent copy quality as to density, resolution and background levels. Similar results were obtained with the other copolymers of the Table.

EXAMPLE 2

Coated steel shot carrier particles were made and tested as follows : 3000 g of 20–35 mesh steel shots were placed in a tumbling barrel type mixer. Then 208 g of a 10 percent by weight solution of the copolymer of Example 1 in methylene chloride were charged to the tumbling barrel mixer. The resulting mixture was treated in the same way as in Example 1. The beads were mixed with a toner prepared as described hereinafter.

The developer composition was used for the development of positive electrostatic charge patterns obtained on a selenium photoconductive coating. In every respect, including toner pick-up, resolution and overall quality, the copies so obtained were rated "very good".

A toner is prepared from 5.2 parts by weight of resin A, 1 part by weight of resin B, 2.8 parts by weight of resin C and 1 part by weight of carbon black (marketed as Spezialschwarz IV by Degussa, Frankfurt (M), W.-Germany.)

Resin A is a copolymer containing 50% by weight of styrene, 5% by weight of α-methylstyrene and 45% by weight of isobutyl methacrylate.

Resin B is polyvinyl butyral containing approximatively 20% by weight of vinyl alcohol groups and 2.5% by weight of vinyl acetate groups.

Resin C is a copolymer of methyl methacrylate and n-butyl methacrylate (50:50 mole %).

The components are mixed in dry condition and then melted at a temperature of 120°–130° C. The melt is then kneaded for approximatively 30 min at the same temperature. After cooling and breaking to a particle size of approximatively 1 mm the powder is ground for 15 h in aqueous medium in a vibration ball mill. After drying and sieving, a toner having a particle size of about 10 μm with a fixing (softening) temperature of approximatively 110° C is obtained.

1 kg of the thus obtained toner is mixed with 1.8 g of AEROSIL 300 (trade name of Degussa, Frankfurt (M), W. Germany) in a cylindrical ball mill of 5 litres containing porcelain balls. AEROSIL 300 is a colloidal silica having a specific surface area of 300 sq.m/g.

The ball mill is rotated for 15 min, the rotational movement being obtained by two rollers axially driven in the same sense and carrying the ball mill cylinder between them.

After removal of the porcelain balls the mixture of toner and AEROSIL 300 particles is added in an amount of 0.5 g to 100 g of carrier particles prepared as described above.

We claim:

1. Carrier beads consisting essentially of a glass core or iron-containing metal core enveloped with a coating of a copolymer of N-vinylcarbazole, trialkoxyvinylsilane and/or triacetoxyvinylsilane and optionally at least one monomer of the group consisting of $C_1$–$C_4$ alkyl acrylate or methacrylate and styrene, said copolymer comprising at least 50% by weight of said N-vinylcarbazole units and from 0.5 to 10% by weight of said trialkoxyvinylsilane and/or triacetoxyvinylsilane units.

2. Carrier beads according to claim 1, wherein the copolymer contains from 50 to 70% by weight of N-vinylcarbazole, from 25 to 48% by weight of methyl acrylate and from 2 to 5% by weight of triacetoxyvinylsilane units.

3. Carrier beads according to claim 1, wherein the copolymer contains from 50 to 70% by weight of N-vinylcarbazole, from 25 to 48% by weight of methyl acrylate and from 2 to 5% by weight of trimethoxyvinylsilane or triethoxyvinylsilane units.

4. Carrier beads according to claim 1, wherein the diameter of the beads is in the range of 30 to 1500 μm.

5. An electrostatographic developer mixture comprising finely-divided toner particles electrostatically clinging to the surface of carrier beads said beads consisting essentially of a glass core or iron-containing metal core eveloped with a coating of a copolymer of N-vinylcarbazole, trialkoxyvinylsilane and/or triacetoxyvinylsilane and optionally at least one monomer of the group consisting of $C_1$–$C_4$ alkyl acrylate or methacrylate and styrene, said copolymer comprising at least 50% by weight of said N-vinylcarbazole units and from 0.5 to 10% by weight of said trialkoxyvinylsilane and/or triacetoxyvinylsilane units.

6. An electrostatographic developer mixture according to claim 5, wherein the copolymer contains from 50 to 70% by weight of N-vinylcarbazole, from 25 to 48% by weight of methyl acrylate and from 2 to 5% by weight of trimethoxyvinylsilane and/or triethoxyvinylsilane units.

7. An electrostatographic developer mixture according to claim 5, wherein the carrier beads have a diameter in the range of 30 to 1500 μm.

8. An electrostatographic imaging process comprising the steps of forming an electrostatic charge image in or on a solid insulating surface and developing said electrostatic charge image with a developer mixture comprising finely-divided toner particles electrostatically clinging to the surface of carrier beads consisting essentially of a glass core or iron-containing metal core enveloped with a coating of a copolymer of N-vinylcarbazole, trialkoxyvinylsilane and/or triacetoxyvinylsilane and optionally at least one monomer of the group consisting of $C_1$–$C_4$ alkyl acrylate or methacrylate and styrene, said copolymer comprising at least 50% by weight of said N-vinylcarbazole units and from 0.5 to 10% by weight of said trialkoxyvinylsilane and/or triacetoxyvinylsilane units.

* * * * *